US007798748B2

(12) United States Patent
La

(10) Patent No.: US 7,798,748 B2
(45) Date of Patent: Sep. 21, 2010

(54) DOUBLE WALL STRUCTURE TYPE MECHANICALLY STABILIZED EARTH WALL SYSTEM

(75) Inventor: Seung Min La, Seoul (KR)

(73) Assignee: Research Institute of Industrial Science & Technology, Pohang, Kyungsangbuk-do (KR)

( * ) Notice: Subject to any disclaimer, the term of this patent is extended or adjusted under 35 U.S.C. 154(b) by 426 days.

(21) Appl. No.: 11/722,611

(22) PCT Filed: Dec. 23, 2005

(86) PCT No.: PCT/KR2005/004499

§ 371 (c)(1),
(2), (4) Date: Jun. 22, 2007

(87) PCT Pub. No.: WO2006/068447

PCT Pub. Date: Jun. 29, 2006

(65) Prior Publication Data

US 2008/0095585 A1 Apr. 24, 2008

(30) Foreign Application Priority Data

Dec. 24, 2004 (KR) ..... 10-2004-0111829

(51) Int. Cl.
*E02D 29/02* (2006.01)

(52) U.S. Cl. ..... 405/285

(58) Field of Classification Search ..... 405/262, 405/284, 285, 302.4, 302.6, 302.7; 256/12.5
See application file for complete search history.

(56) References Cited

U.S. PATENT DOCUMENTS

| | | | | |
|---|---|---|---|---|
| 4,923,339 | A | 5/1990 | Smith | |
| 5,647,695 | A * | 7/1997 | Hilfiker et al. | 405/284 |
| 6,074,132 | A * | 6/2000 | Davies et al. | 405/129.6 |

FOREIGN PATENT DOCUMENTS

| | | |
|---|---|---|
| JP | 07-310324 A | 11/1995 |
| JP | 09-256398 A | 9/1997 |

* cited by examiner

*Primary Examiner*—John Kreck
(74) *Attorney, Agent, or Firm*—Lexyoume IP Group, PLLC.

(57) ABSTRACT

Disclosed is a mechanically stabilized earth (MSE) wall system for preventing collapse of a retaining wall. The MSE wall system includes: at least two pillars installed on a front surface of the retaining wall; a plurality of screens installed on a rear surface of the pillar and arranged along a vertical direction to intercept a space between the adjacent pillars; at least a connector installed between the adjacent pillars to preserve a space between the adjacent pillars and prevent the screens from being separated into a front direction; and at least a front panel spaced from a front surface of the screen. Since deformation of the screen which supports the load of the backfilling soil is not transferred to the front panel, it is possible to provide excellent appearance.

10 Claims, 8 Drawing Sheets

PRIOR ART

DOUBLE WALL STRUCTURE TYPE MECHANICALLY STABILIZED EARTH WALL SYSTEM

BACKGROUND OF THE INVENTION (a) Field of the Invention

The present invention relates to a mechanically stabilized earth (MSE) wall, and more particularly, to a MSE wall system having a double wall structure for preventing deformation of the rear screen, which supports the load of the backfill, from being transferred to the front panel forming the appearance of the retaining wall.

(b) Description of the Related Art

Conventionally, a mechanically stabilized earth (MSE) wall, which was developed in 1960s, has been constructed using a front panel made of a thin steel panel and reinforcing elements such as metal strips. This first-introduced type MSE wall resisted the external loads by minimizing the soil pressure applied to the front panel by the frictional resistance of the reinforcing elements and by structurally strengthening the backfill by compaction along with inserted reinforcements. In addition, the front panel was made using thin steel plates to maximize its functionality by allowing the soil pressure applied thereon to be deformed to minimize the actual load. However, using the thin plates for the front panels brought up secondary problems such as local deformation and corrosion which resulted in poor aesthetic appearance. As a result, the first-introduced type of MSE wall was not widely applied.

Afterwards, relating technologies have been developed, so that the MSE wall structure has been modified as shown in FIG. 1. Specifically, the front panel is structured in concrete panels or blocks, and then mechanically stabilized by inserting reinforcing elements such as steel strips, fibers or plastic-based reinforcing elements having polymer coatings. The front panel made of a rigid body such as a concrete panel or block may provide excellent appearance. However, it is not structurally stabilized because stress is concentrated on a jointing portion between the rigid front panel and the reinforcing element installed to reinforce the rear ground which structurally exhibits flexible behavior. As a result, fracture may be generated in the jointing portion. In addition, considering that the entire structure should exhibit flexible behavior, the rigid front panel is not advantageous to the safety of the entire structure. For this reason, the conventional MSE structure has various problems such as local deformation, fracture in the jointing area, and global deformation due to long-time creep. Continuous development in technologies promotes complementary countermeasures such as slide joints, separated front panels, etc. in order to solve such problems. Unfortunately, such countermeasures proved to be not a substantial solution but just variations of specifications to alleviate the problems.

SUMMARY OF THE INVENTION

The present invention has been made to solve the aforementioned problems, and the object of the invention is to provide a mechanically stabilized earth (MSE) wall system having a double wall structure, in which a vacant space is provided between the rear screen for supporting the backfill and the front panel for forming exterior of the retaining wall. This invention allows the rear screen to deform to a certain degree enabling flexible behavior which can improve the safety of the retaining wall without having the deformation of the screen generating deformation of the front panel.

According to an aspect of the present invention, there is provided a mechanically stabilized earth (MSE) wall system for preventing collapse of a retaining wall, the MSE wall system comprising: at least two pillars installed on a front surface of the retaining wall; a plurality of screens installed on a rear surface of the pillar and arranged along a vertical direction to intercept a space between the adjacent pillars; at least a connector installed between the adjacent pillars to secure spacing between the adjacent pillars and prevent the screens from being separated into a front direction; and at least a front panel installed in front of the screen with a spacing in between.

The connector may be positioned at the adjoining line of the screens.

The MSE wall system may further comprise an upper cover installed on top of the pillars to cover a space between the screen and the front panel.

The MSE wall system may further comprise at least a reinforcing element installed on the pillar and deeply inserted into the backfill.

The MSE wall system may further comprise a reinforcing element installed on the connector and deeply inserted into the backfill.

The front panel may be installed on a front surface of the pillar.

The screens may be installed on a front surface of the pillars with a predetermined interval, the front panel may be installed on a spacing member provided on the pillar with a predetermined interval, and the spacing member may protrude from the pillar.

The screens may be installed between the pillar and the connector with a predetermined interval, the front panel may be installed on a spacing member provided on the pillar with a predetermined interval, and the spacing member may protrude from the pillar.

The spacing member may be an anchor bolt.

The pillar, the connector, and the front panel may be prefabricated as a single unit.

The MSE wall system may further comprise a reinforcing element installed on the screen and deeply inserted into the backfill.

Connecting members may be installed on a front surface of the pillar with a predetermined interval, and the front panel may be combined with the connecting member.

According to the present invention, an MSE wall system can be constructed by directly assembling together each factory manufactured parts at the construction site allowing the benefits of easier and faster construction of the retaining wall. Accordingly, the construction period can be significantly reduced. In addition, in the MSE wall system according to the present invention, the front panels can be easily replaced and seldom experience deformation. Therefore, the front panel can be variously modified depending on consumer's desire.

Furthermore, according to the present invention, it is possible to improve safety, which is most important factor in a retaining wall structure, by advantages such as the flexible behavior of the entire structure, reduction of the water pressure through entire surface drainage at the rear screen, excellent adaptive response to dynamic load such as an earthquake or to uneven settlements, alleviation of the stress concentration on reinforcing elements and jointing portions by allowing deformation of the backside screens. Furthermore it is possible to prevent effluent groundwater from harming appearance of the retaining wall and to obtain a drainage path through the vacant space between the front panel and the rear screen.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Preferred embodiments of the present invention will now be described in detail with reference to the accompanying drawings.

Figure 1:
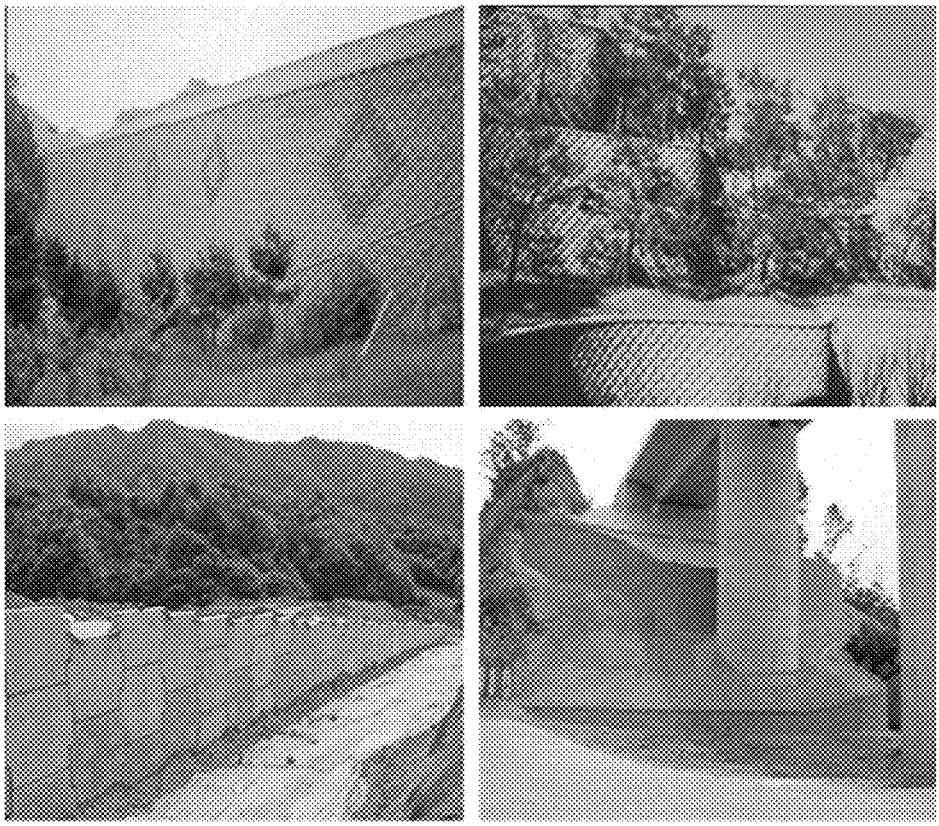
FIG. 1 is a set of photographs taken of conventional mechanically-stabilized earth (MSE) walls.
Figure 2:
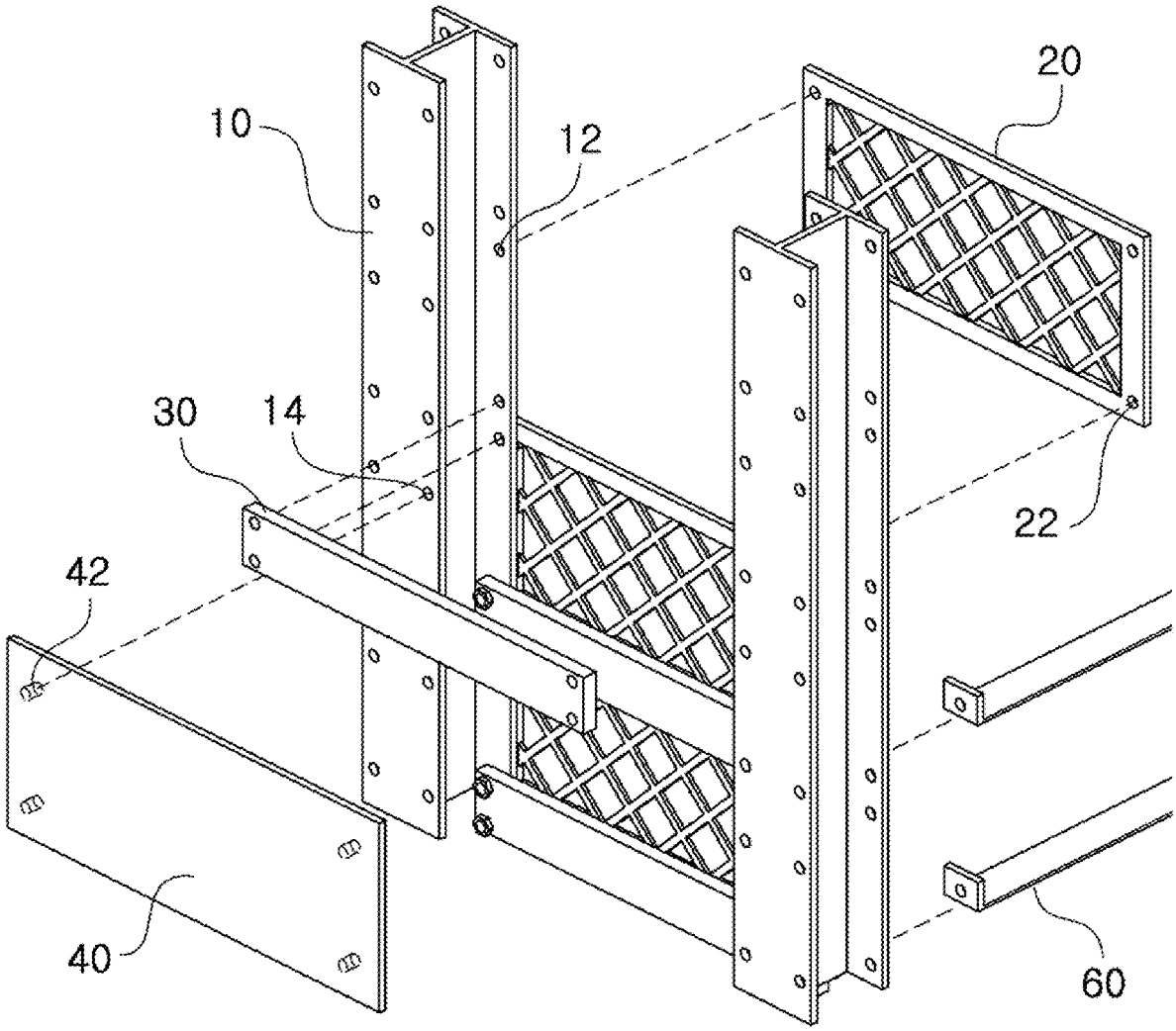
FIG. 2 is an exploded perspective view illustrating an MSE wall system having a double wall structure according to an exemplary embodiment of the present invention.
Figure 3:
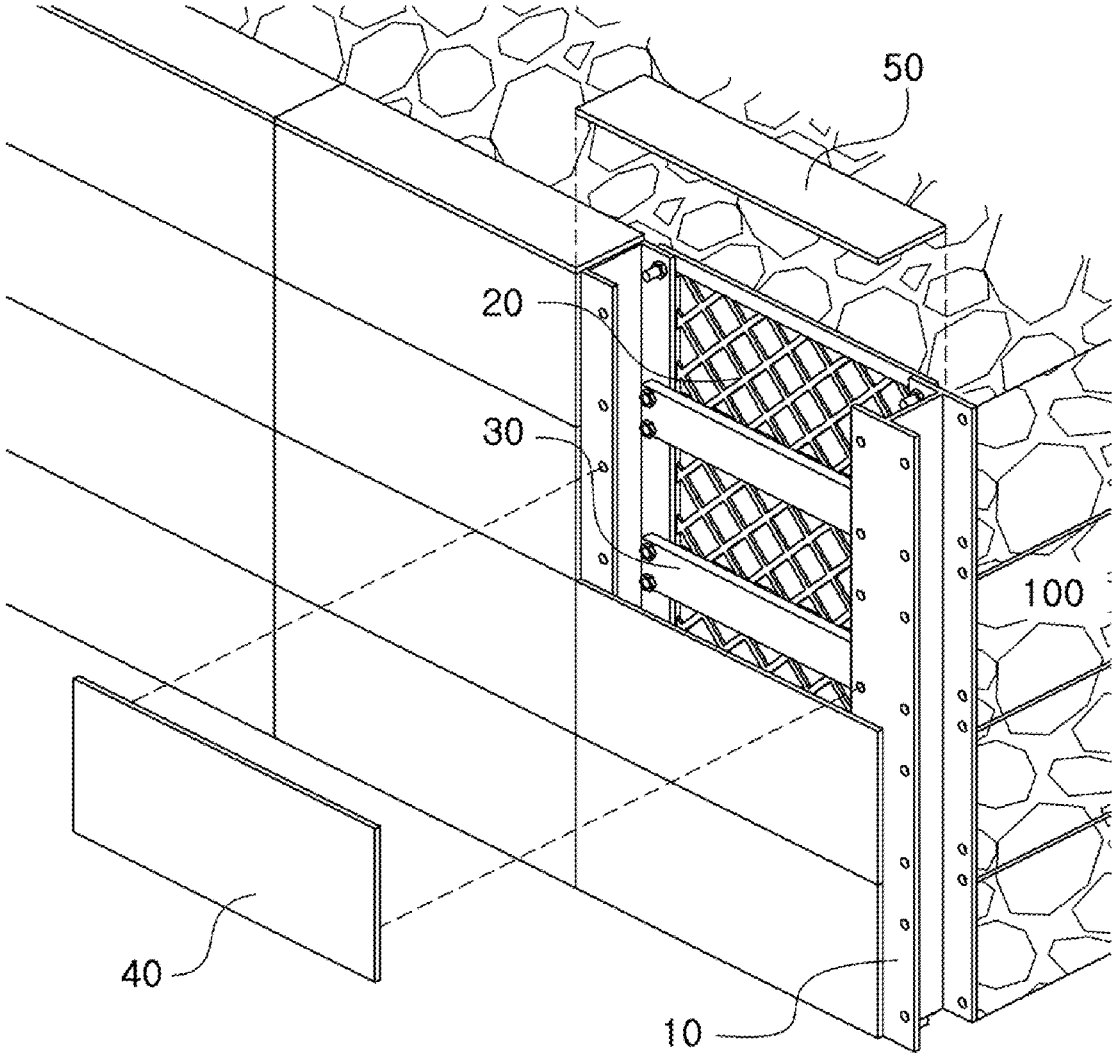
FIG. 3 is a perspective view illustrating an example of installation of a retaining wall system shown in FIG. 2.
Figure 4:
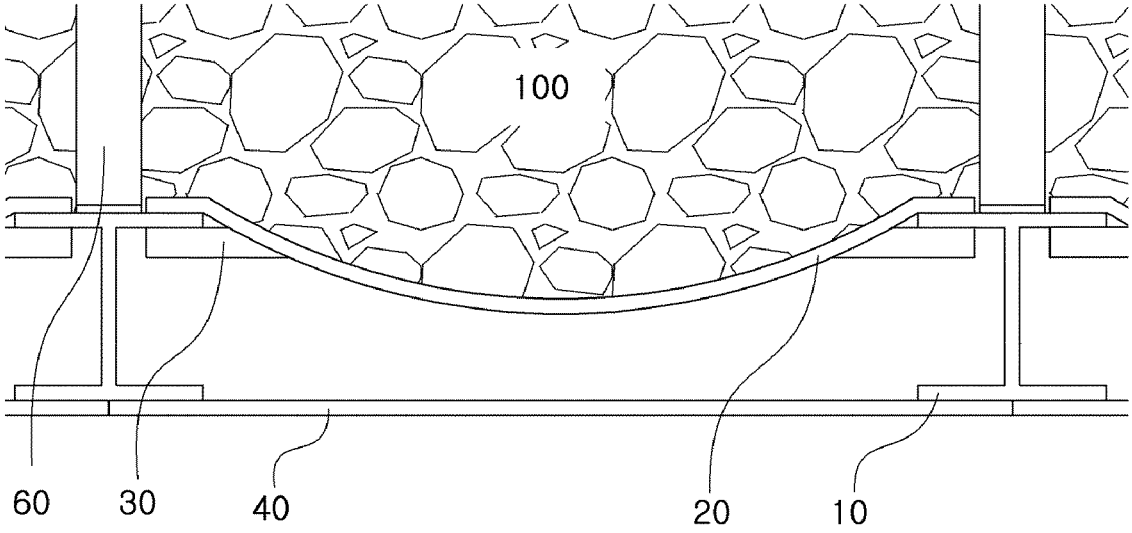
FIG. 4 is a top plan view of FIG. 3.
Figure 5:
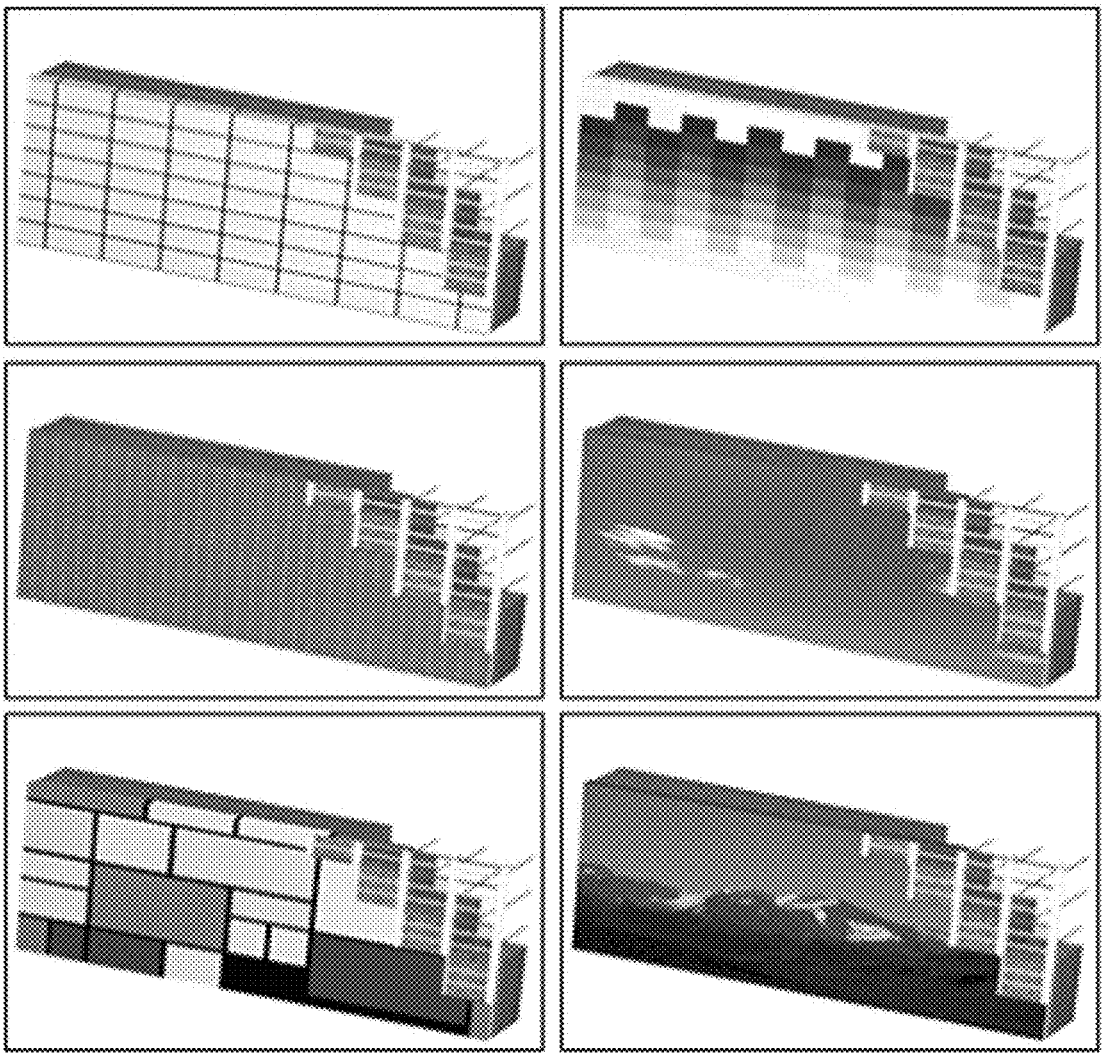
FIG. 5 is a set of photographs taking various shapes of front panels installed in a retaining wall system of FIG. 2.

FIG. 2 is an exploded perspective view illustrating a mechanically stabilized earth (MSE) wall system having a double wall structure according to an exemplary embodiment of the present invention. FIG. 3 is a perspective view illustrating an example of installation of a retaining wall system shown in FIG. 2. FIG. 4 is a top plan view of FIG. 3. FIG. 5 is a set of photographs taking various shapes of front panels installed on a retaining wall system of FIG. 2.

As shown in FIG. 2, a retaining wall system according to the present invention includes pillars 10, screens 20, connectors 30, and front panels 40.

The pillar 10 is a member for supporting pressure of the reinforcing earth. A plurality of pillars are arranged with a predetermined interval along the side surface of the backfilling soil 100. Although an H-shape beam is used as a pillar 10 in this embodiment, various types or shapes of members can be adapted if they provide a sufficient spacing between the screen 20 and the front panel 40. Preferably, the pillar 10 may have various cross-sectional shapes such as an H-shape beam, a rectangular beam, and a C-shape beam. In addition, according to the present embodiment, a spacing member (not shown) capable of providing a predetermined interval may be combined with the pillar 10 having a flat shape, and then the front panel 40 may be installed in the end of the spacing member to provide a spacing between the front panel 40 and the screen 20. The spacing member may include an anchor bolt.

A plurality of fixing holes 12 and 14 may be provided in the front and rear surfaces of the pillar 10 along its longitudinal direction with a predetermined interval. In this case, the fixing holes 12 provided in the rear surface of the pillar 10 may be horizontally wide to obtain mobility of the screen 20.

The screen 20 is a member for preventing collapse of the backfilling soil 100. The screen 20 has breaches in order to prevent local landslide and soil run out but to allow drainage. According to the present embodiment, the screen 20 having a mesh shape is provided to achieve the aforementioned function. Both ends of the screen can be provided with fixing holes 22. Accordingly, the screen 20 is installed between two different pillars 10 by means of the bolts jointed with the fixing holes 12 and 22. Meanwhile, the screen 20 is preferably made of a soft material to absorb the pressure of the reinforcing soil a little.

The connector 30 prevents the screen 20 from being broken away by the pressure of the backfilling soil 100. It also serves to control deformation of the screen 20, transfer loads between the pillars, and control shearing deformation (i.e., uneven settlement in a longitudinal direction) in the front portion of the retaining wall. For this purpose, the connectors 30 are spaced with a predetermined interval in a longitudinal direction of the pillar 10 to support the front surface of the screen 20. The narrower interval between the adjacent connectors would provide a strong support. However, if the interval is excessively narrow, the screen 20 is seldom deformed by the pressure of the backfilling soil. If this is the case, the pressure of the backfilling soil 100 is not absorbed into the screen 20, and directly transferred to the pillar 10, so that safety of the retaining wall weakened. Therefore, as shown in the present embodiment, the connector 30 is preferably installed in the adjoining line of the screens 20 to allow deformation of the screen as large as possible and prevent separation of the screen 20. Various members such as an L-shape beam, an H-shape beam, a steel beam, a rectangular steel beam, and a C-shape beam can be used as the connector 30.

The front panel 40 hides the inner structure of the retaining wall having pillars 10, screens 20, and connectors 30 so that we cannot see them from external to provide excellent appearance. The front panel 40 may be made of a material that can be easily painted or figured, such as wood, steel plate, concrete, stainless steel, and plastic. Furthermore, the front panel 40 may be finished in various shapes such as embossment or ripples to provide excellent appearance. The rear side of the front panel 40 is provided with a plurality of protrusions 42. Accordingly, the front panel 40 can be combined with the pillars 10 by means of the protrusions 42.

In addition, a reinforcing element 60 may be provided in the rear side of the pillar 10, the connector 30, or the screen 20. As shown in FIGS. 3 and 4, the reinforcing element 60 is deeply inserted into the backfilling soil 100 to prevent the pillar from falling down.

Such a retaining wall system according to the present embodiment can provide excellent appearance as shown in FIG. 3. Therefore, the retaining wall system according to the present invention can be installed anywhere with a harmonized appearance. In addition, an upper cover 50 may be provided on the retaining wall to prevent a landslide or rainwater from flowing into a gap between the screen 20 and the front panel 40.

Meanwhile, unlike a conventional retaining wall, since the screen 20 and the front panel 40 are spaced with a predetermined interval in the retaining wall according to the embodiment of the present invention, the front panel 40 is seldom deformed. Conventionally, as shown in FIG. 4, the retaining wall was susceptible to deformation due to the pressure of the backfilling soil 100 because the screen 20 was not spaced from the front panel. Furthermore, in a conventional retaining wall, the front panel installed in front of the screen 20 intercepts a drainage path of rainwater or groundwater, so that the entire load applied to the retaining wall increases.

However, according to the embodiment of the present invention, as shown in FIG. 4, the screen 20 is spaced from the front panel with a predetermined interval. Therefore, the rainwater or groundwater drained through the screen 20 can be appropriately discharged. In addition, since the deformation of the screen 20 is not propagated to the front panel 40, the front panel can remain in its initial shape. Since the front panel 40 is not susceptible to deformation by the backfilling soil 100, the front panel 40 can be made of various materials with various colors and shapes as shown in FIG. 5 unlike the conventional ones. The front panels 40 shown in FIG. 5 are just exemplary, but other shapes or colors may be used in the front panel 40.

Figure 6:
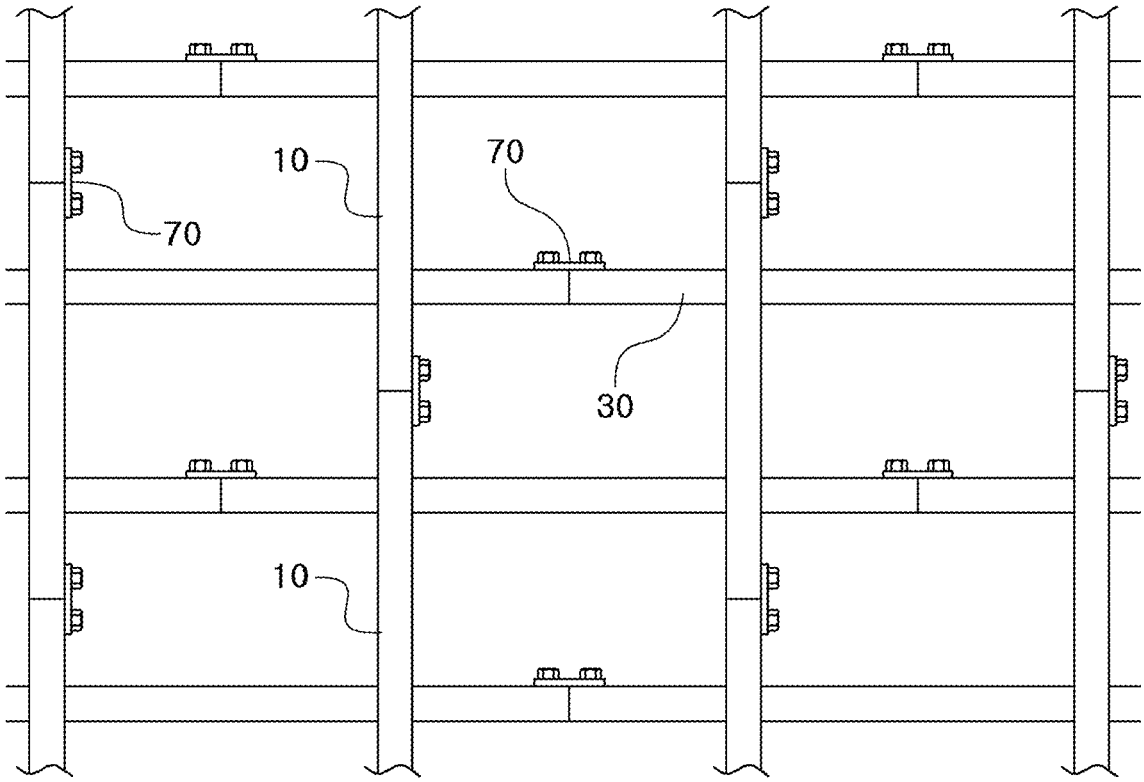
FIG. 6 is a front view illustrating arrangement of pillars and connectors in a mechanically stabilized earth wall system according to another embodiment of the present invention.
Figure 7:
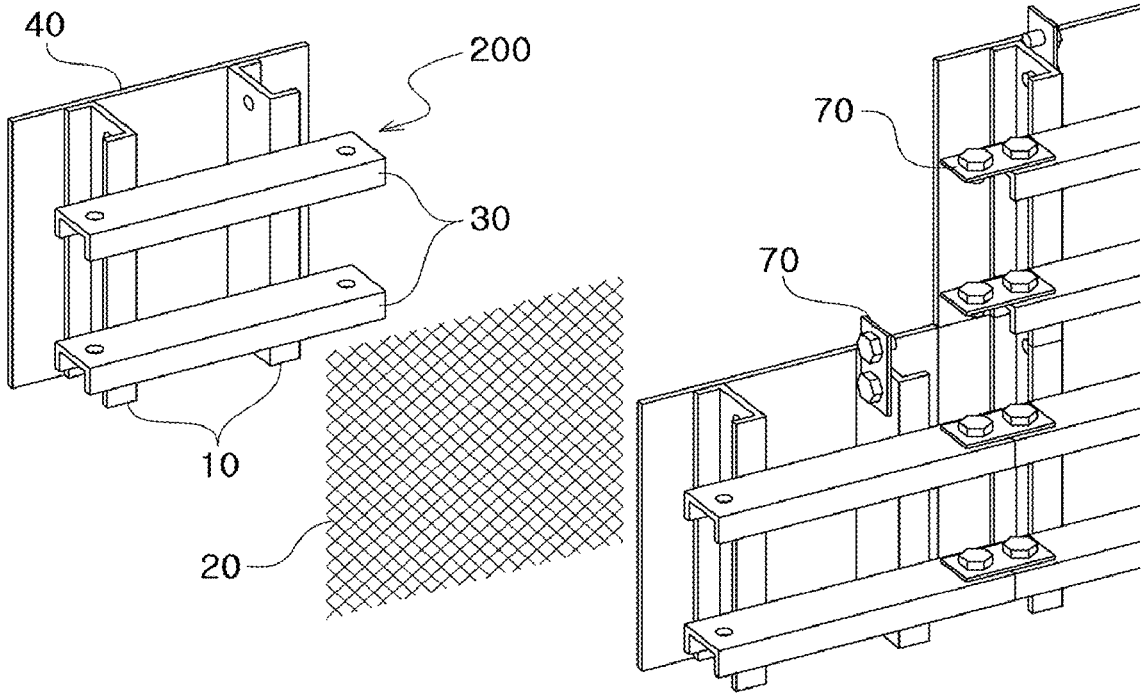
FIG. 7 is an exploded perspective view illustrating a unit entity of a mechanically stabilized earth wall system according to another exemplary embodiment of the present invention.

FIG. 6 is a front view illustrating arrangement of pillars and connectors in an MSE wall system according to another exemplary embodiment of the present invention. FIG. 7 is an exploded perspective view illustrating a unit entity of an MSE wall system according to another exemplary embodiment of the present invention.

According to another embodiment of the present invention, the pillars 10 and the connectors 30 are crossed with each other to consolidate their engagement structure as shown in FIG. 6. In this case, the pillars 10 are connected with each other by engaging bolts or rivets with the connecting plate 70 interposed, and the connectors 30 are connected with each other by engaging bolts or rivets with the connecting plate 70 interposed.

Further, according to another embodiment of the present invention, the pillar 10, the connector 30, and the front panel 40 may be previously manufactured in a factory as a single unit kit 200 as shown in FIG. 7, and a plurality of unit kits 200 may be assembled in the construction site using the connecting plates 70, and bolts or rivets. In this case, it is preferable to separately manufacture the screen 20 and then assemble them in the construction site. This is because it would be difficult or impossible to assemble the unit kits 200 with each other if the screen 20 is previously combined. The screen 20 may be combined with the unit kit 200 using bolts or through welding.

Meanwhile, in the embodiments shown in FIGS. 2 and 3, since the front panel 40 is installed between two adjacent pillars 10, the length of the front panel 40 may be adaptively adjusted depending on the interval between the adjacent pillars 10.

Typically, the interval between the adjacent pillars is adjustable. However, if the interval is set to be shorter, more pillars 10 should be accordingly used. It may cause cost increase in materials and installation. For this reason, in most of the cases, the front panel 40 is constructed as long as possible depending on the interval between the adjacent pillars 10.

If the front panel 40 is too long, since bending moment may be easily generated even by a small external force or weather changes, the front panel 40 should be thicker. However, if the front panel 40 is constructed in a larger thickness, the manufacturing cost and its weight accordingly increase.

Figure 8:
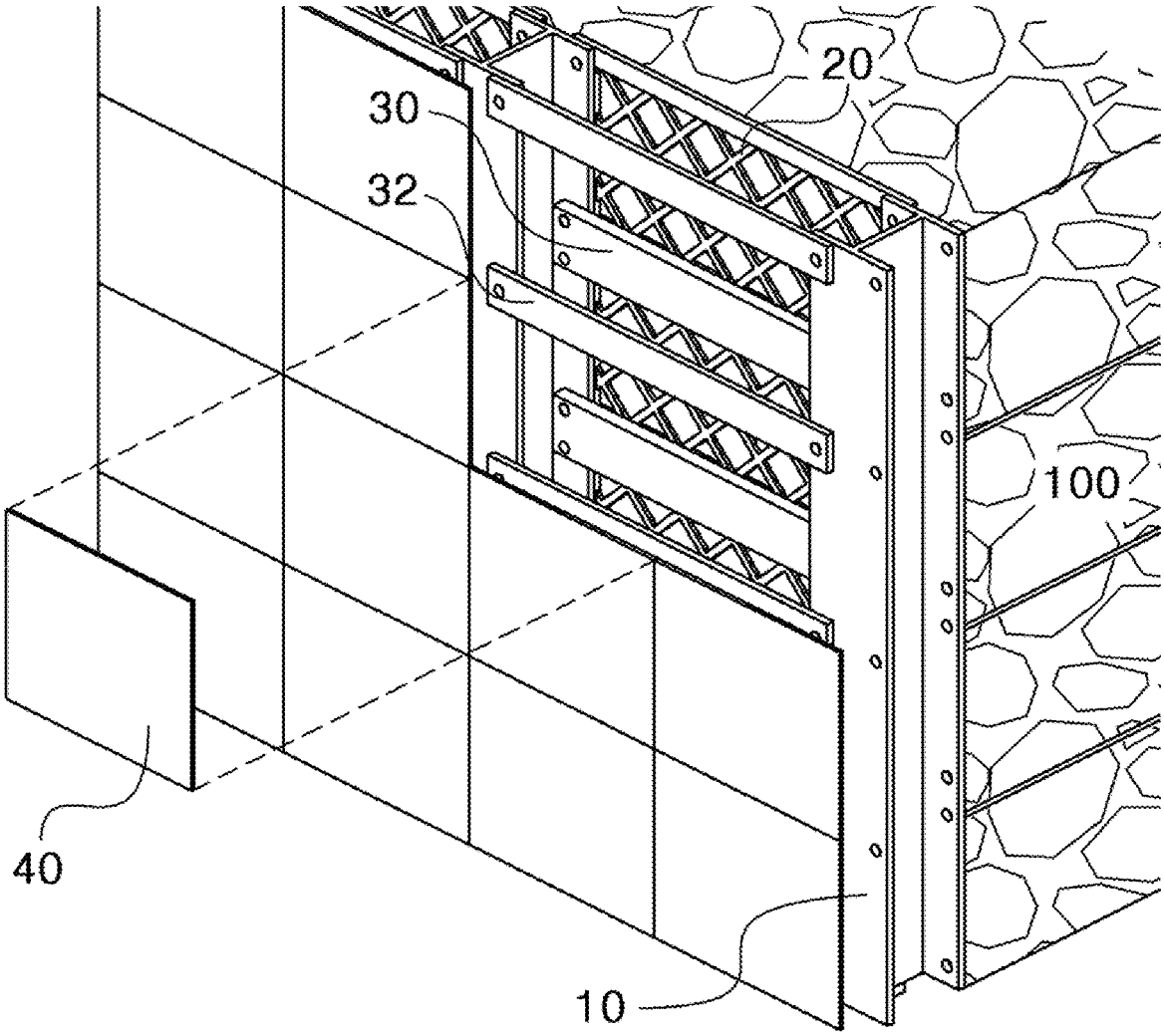
FIG. 8 is a perspective view illustrating a mechanically stabilized earth wall system according to another exemplary embodiment of the present invention.

The embodiment shown in FIG. 8 is made to consider such a problem.

In this embodiment, connectors 32 are further provided in the front surfaces of the pillars 10 as shown in FIG. 8.

The front panel 40 is constructed in an appropriate size and combined with the connector 32. In the present embodiment, the length of the front panel 40 is set to a half of the interval between the adjacent pillars 10. As such, if the length of the front panel 40 is reduced, the bending moment of the front panel can be accordingly reduced, and thus, the thickness of the front panel 40 can be smaller. If the front panel 40 becomes thin, its conveyance and installation may be easier, and thus, the retaining wall system can be completed earlier.

While an MSE wall system having a double wall structure according to the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A mechanically stabilized earth (MSE) wall system for preventing collapse of a retaining wall, the MSE wall system comprising:

at least two pillars installed on a front surface of the retaining wall;

a plurality of screens installed on a rear surface of the pillars and arranged along a vertical direction to intercept a space between adjacent pillars;

at least a connector installed between the adjacent pillars to preserve a space between the adjacent pillars and prevent the screens from being separated into a front direction; and at least a front panel installed on a front surface of the pillars, the front panel being spaced apart from a front surface of the screens, wherein the connector is disposed in an adjoining section of the screens and there is a space between the screens and the front panel.

2. The MSE wall system of claim 1, further comprising an upper cover installed on a top of the pillars to cover a space between the screens and the front panel.

3. The MSE wall system of claim 1, further comprising at least a reinforcing element installed on the pillars and inserted into an inside of the retaining wall.

4. The MSE wall system of claim 1, further comprising a reinforcing element installed on the connector and inserted into an inside of the retaining wall.

5. The MSE wall system of claim 1, wherein the screens are installed on the front surface of the pillars with a predetermined interval, the front panel is installed on a spacing member provided on the pillars with a predetermined interval, and the spacing member protrudes from the pillars.

6. The MSE wall system of claim 1, wherein the screens are installed between the pillars and the connector with a predetermined interval, the front panel is installed on a spacing member provided on the pillars with a predetermined interval, and the spacing member protrudes from the pillars.

7. The MSE wall system of claim 6, wherein the spacing member is an anchor bolt.

8. The MSE wall system of claim 1, wherein the pillars, the connector, and the front panel are prefabricated as a single unit.

9. The MSE wall system of claim 1, further comprising a reinforcing element installed on the screens and inserted into an inside of the retaining wall.

10. The MSE wall system of claim 1, wherein connecting members are installed on the front surface of the pillars with a predetermined interval, and the front panel is combined with the connecting members.

* * * * *